US006038827A

United States Patent [19]

Sieling

[11] Patent Number: 6,038,827

[45] Date of Patent: Mar. 21, 2000

[54] TRILAMINATE ROOFING SHINGLE

[75] Inventor: Frederick W. Sieling, Bound Brook, N.J.

[73] Assignee: Building Materials Corporation of America, Wayne, N.J.

[21] Appl. No.: 09/203,971

[22] Filed: Dec. 2, 1998

[51] Int. Cl.[7] ..... E04D 1/26

[52] U.S. Cl. ..... 52/557; 52/314; 52/554; 52/555; 52/559; 52/540; 428/143

[58] Field of Search ..... 52/311.2, 314, 52/557, 558, 559, 540, 553, 554, 555; 428/143

[56] References Cited

U.S. PATENT DOCUMENTS

| | | | |
|---|---|---|---|
| D. 366,124 | 1/1996 | Hannah et al. | D25/139 |
| 1,593,095 | 7/1926 | Munro | 52/557 |
| 1,596,272 | 8/1926 | Jordan | 58/554 X |
| 1,601,731 | 10/1926 | Flood | 52/555 |
| 1,705,497 | 3/1929 | Overbury | 52/557 |
| 1,894,614 | 1/1933 | Wettlaufer | 52/559 |
| 1,894,615 | 1/1933 | Wettlaufer | 52/559 X |
| 3,624,975 | 12/1971 | Morgan et al. | 52/555 X |
| 3,921,358 | 11/1975 | Bettoli | 52/314 |
| 4,274,243 | 6/1981 | Corbin et al. | 52/557 X |
| 4,559,267 | 12/1985 | Freshwater et al. | 428/352 |
| 4,717,614 | 1/1988 | Bondoc et al. | 52/559 X |
| 4,869,942 | 9/1989 | Jennus et al. | 52/557 X |
| 5,195,290 | 3/1993 | Hulett | 52/518 |
| 5,209,802 | 5/1993 | Hannah et al. | 52/540 X |
| 5,369,929 | 12/1994 | Weaver et al. | 52/557 |
| 5,853,858 | 12/1998 | Bondoc | 52/554 X |
| 5,860,263 | 1/1999 | Sieling et al. | 52/557 X |
| 5,939,169 | 8/1999 | Bondoc et al. | 428/77 X |

FOREIGN PATENT DOCUMENTS

| | | | |
|---|---|---|---|
| 963626 | 3/1975 | Canada | 52/553 |

*Primary Examiner*—Laura A. Callo
*Attorney, Agent, or Firm*—Marilyn J. Maue; William J. Davis

[57] ABSTRACT

A trilaminated roofing shingle comprising:

(a) an anterior layer consisting essentially of a rectangular, granular surfaced shingle sheet having an undivided headlap portion and a butt portion comprising a plurality of tabs of an average given breadth separated by spaces approximately 0.50 to 1.25 the breadth of a tab;

(b) a middle layer consisting essentially of a longitudinally coextensive rectangular, granular surfaced shingle sheet of an overall width up to equal the width of the anterior layer, having the same number of tabs of complementary configuration as those of (a), said tabs of (b) uniformly larger in breadth or breadth and height with respect to the tabs of (a) but insufficient to fill the spaces between the tabs of (a), so as to allow spaces between tabs of (b) when assembled, middle layer (b) being attached to the undersurface of anterior layer (a) in a manner such that the tabs of (b) are centered under the tabs of (a) and partially fill the spaces between the tabs of (a) and (c) a posterior layer of an undivided, longitudinally coextensive rectangular strip exposable through and filling the spaces and having granules on its surface in at least its exposed areas, strip (c) having a width greater than the height of the tabs of (b) and being attached to the undersurface of (b).

18 Claims, 3 Drawing Sheets

TRILAMINATE ROOFING SHINGLE

FIELD OF THE INVENTION

In one aspect this invention relates to a roofing shingle having the bulk and configuration of natural shake and slate shingles with excellent fire resistance and protection against weathering while retaining the substantially reduced cost of conventional asphalt shingles over shakes and slate roof coverings.

In another aspect the invention relates to multicolored shingles simulating the shades and colors of natural materials heretofore unachieved to provide an improved aesthetic appearance.

BACKGROUND OF THE INVENTION

This invention pertains to a three layer composite, asphalt impregnated shingle having superior weather resistance and an aesthetic appearance which closely simulates more expensive roofing.

Roofing shingles comprising felt or fabric stock impregnated with asphalt and covered with weather resistant mineral granules are well known. Heretofore they have served as relatively inexpensive alternatives to tile, slate and wood roofing shingles. Although asphalt shingles are fire-resistant, provide good weather protection and are renownedly durable, their substantially planar appearance has made them less pleasing to the eye and less imposing than their more expensive counterparts.

Prior asphalt shingles having areas of different colors or color shading have not been successfully commercialized since their unnatural horizontal stripes and indefinable demarcations between the colors create an artificial appearance. Further their horizontal transitional area between colors is contrary to the shadings of natural wood and slate. Thus they do not present the subtle variegation of colors which is associated with abutting natural shingles.

Due to the uncontrolled mixtures of granule sizes in existing asphalt shingles, variation in surface texture exist and unsightly "off color" areas, which are caused by differences in the light reflective characteristics of granules of different sizes imbedded in the shingle, are unpleasantly noticeable.

Accordingly, asphalt shingles heretofore available are at a competitive disadvantage with the more expensive roofing shingles because they lack bulky edge profile, surface contour and color blends which are characteristic of slate and wood shingles. Finally, the installation of conventional composite shingles is tedious and time consuming because such shingles are applied in a regular pattern which requires precise alignment of adjacent courses so as to avoid a haphazard wavy appearance.

Many futile attempts have been made in the prior art to provide asphalt shingles which would achieve the substantial structural and architectural appearance as well as chromic affects characteristic of wood or slate roofing shingles. For example, the prior art suggests that an asphalt shingle may be endowed with a massive ornamental effect by securing an additional riser member beneath the spaced tabs of a conventional shingle. However, the resulting structure, although massive, provides a bumpy butt edge profile and an unattractive surface contour. It has also been proposed that an asphalt shingle be constructed with a plurality of tongues, the upper ends of which are free and the lower ends of which are integral with the body of the shingle. A strip is placed behind the body of the shingle but in front of the tongues which have been fastened to the deck. Such structure provides only a single thickness, uniform butt edge profile and regular, insignificant discontinuities in the surface contour.

Manufacturers of asphalt shingles have long recognized the above problems and have sought to improve the appearance of asphalt shingles by various means including the use of many colors and variations in the configuration or elevation of the tabs. Attempts have also been made to produce irregular surface contours which would give the shingle a bulkier appearance but these efforts have not been commercially rewarded. The goal of producing an inexpensive asphalt shingle which has the physical appearance of more expensive wood and slate shingles has eluded those skilled in the art.

Accordingly, it is an object of this invention to overcome the disadvantages outlined above for asphalt roofing shingles.

Another object is to provide a relatively inexpensive roofing shingle which more closely simulates wood shake or slate shingles by a commercially feasible process.

Another object is to provide roofing which is both aesthetically pleasing and resistant to weathering.

Yet another object is to provide a shingle which facilitates installation on a roof.

These and other objects of the invention will become apparent from the following description and disclosure.

DEFINITIONS

For the purposes of this invention, the term breadth refers to the horizontal dimension of a tab; height refers to the length of the tab extending from the bottom boundary of the headlap to its bottom most edge; length indicates the overall horizontal dimension of the strip, shingle sheet or shingle unit and width indicates the overall vertical dimension of a strip, shingle sheet or shingle unit. The complementary configuration of tabs in sheet (b) indicates that they are of the same but enlarged general shape as tabs in sheet (a).

THE INVENTION

In accordance with this invention there is provided an asphalt impregnated, trilaminated, composite roofing shingle comprising:

(a) an anterior layer consisting essentially of a rectangular, granular surfaced shingle sheet having an undivided headlap portion and a butt portion comprising a plurality of tabs of an given average breadth separated by spaces approximately 0.50 to 1.25 the breadth of a tab;

(b) a middle layer consisting essentially of a longitudinally coextensive rectangular, granular surfaced shingle sheet of an overall width up to equal the width of the anterior layer, having the same number of tabs of complementary configuration as those of (a), said tabs of (b) larger in breadth or breadth and height with respect to the tabs of (a) but narrower than the spaces between the tabs of (a), said middle layer being attached to the undersurface of said anterior layer in a manner such that the tabs of (b) are centered under the tabs of (a) and partially fill the side spaces between the tabs of (a) and (c) a posterior layer of an undivided, longitudinally coextensive rectangular strip exposable through and completely filling lateral spaces between said mated tabs of (a) and (b) and having granules on its surface in at least its exposed areas, said strip having a width greater than the height of the tabs of (b) and being attached to the undersurface of (b).

In the present shingle each of the layers (a), (b) and (c) can be composed of one or more plies of asphalt impregnated sheeting, preferably not more than 3 plies thickness, one of which can be an insulation or polymeric sheet material.

The bottom tab edges of (a), and correspondingly those of (b), can be of any shape or design including broken line, serrated, notched, curved, straight line having right angles, curved or crimped corners or a combination of such designs. The spacing of tabs in sheet (a) can be between about 3 to 12 inches and spaces between the tabs of (b) is less than those of (a) and is preferably between about 0.75 and about 4 inches.

Generally, shingle sheet (a) contains 2 to 9 tabs in the anterior butt portion and an equal number in the butt portion of middle layer (b). The size and shape of the tabs in anterior layer (a) are preferably uniform; although, for certain aesthetic affects, tabs irregular in height, breadth and/or shape are also contemplated. The tabs of middle layer (b) simulate those of (a) but are larger in at least one dimension so that a border is formed at the sides and/or ends of tabs (a) when the tabs of (b) are centered under the tabs of (a).

Optionally the bottom edge of headlap (a) can be modified to include orientation means as a guide to facilitate placement of successive courses of shingles in overlapping, offset arrangement. This option aids in accurate, time saving installation for the roofer. The orientation means can be in the form of a mark, slot, slit, indentation or tab located at the surface midsection of the bottom headlap margin of (a) or preferably, for assured alignment, at the midpoint of each space between the tabs of layer (a) on the surface of the bottom headlap margin.

Layer (c) is a substantially undivided rectangular strip longitudinally coextensive with the headlap portion of (a) and underlies the butt portion of middle layer (b). Layer (c) has a width of at least 0.5 inch greater than the butt portion of (b) and, for added bulk, may be so wide as to extend to the full width of layer (a). In the later arrangement, the roof covering at all points of course installation carries a 5 layer covering which is advantageous for heat insulation and in areas subject to high wind velocity. However, under normal conditions, a savings in materials and shingle weight is achieved by limiting the width of the posterior layer to not more than half the width of layer (b) plus a suitable margin for lamination to the lower headlap portion of layer (b).

Although posterior layer (c) can be a continuous, straight edged strip filling the spaces between the tabs and mounted so that its lower marginal edge is flush with the lowermost tab edges of (b), it may also be positioned to extend below the tabs of (b) for a simulated irregular contour and/or shadow effect. Alternatively, the bottom marginal edge of strip (c) can carry indentations which correspond in outline and follow the contour of the bottom tab corners as when the corner or corners of tabs (b) are crimped or curved.

An advantage of the present trilaminated shingle is realized in creating the illustion of tab thickness normally associated with natural shake or slate roof coverings. This affect is obtained by mounting the tabs of (b) under the tabs of (a) in a centered manner while maintaining spaces between tabs which are bridged by the posterior strip (c). The tab thickness and tapestry appearance of the roof covering is particularly pronounced when one or both of the tabbed sheets is composed of a multiply membrane. Color variations between the shingle layers can also contribute to this affect.

At least the exposed portions of all surfaces (a), (b) and (c) carry weather resistant, fire retardant mineral granules of the type conventionally employed for these purposes and which are available in a large variety of colors and in different size grades. Although the granules on the tab surface of each layer can be of one uniform color or can comprise a blending of colors and all layers can be similarly colored, a particularly attractive appearance is achieved when distinguishable or contrasting colors, or contrasting mixtures of colors, are employed for the tabs of each of layers (a) and (b) and optionally layer (c). Contrasting color layers or contrasting mixed colors in each layer, or at least the tabs of each layer, can be used to simulate a shadow effect in the the colors, tones, shadings and blendings of expensive natural wood shake and slate shingles. Shades of white to black as well as brown, red, green, gray, yellow and burnt orange shades and colors can be blended to achieve a desired affect. More specifically, the color or shade of tabs (a) can be in contrast with that of tabs (b); the color or shade of tabs (a) optionally can be in contrast with posterior layer (c); the color or shade of (c) can be in contrast with the tabs of (b) or each layer can have an individual color keyed to create an illusion of depth.

The present trilaminated shingle overcomes many of the difficulties and problems associated with prior multicolored shingles such as the artificial horizontal color stripes or indefinite demarcations between color boundaries which give a tawdry, printed appearance. In the present invention the layers of distinguishable or contrasting color or blends of mixed color in the tabs of layers (a), (b) and/or strip (c) duplicate the appearance of individual shake or slate shingles which normally vary in blends of color or tones unit to unit.

Having generally described the invention, reference is now had to the drawings which illustrate various and preferred embodiments but which are not to be construed as limiting to the scope of the invention as more broadly defined above and in the appended claims.

BRIEF DESCRIPTION OF THE DRAWINGS

FIGS. 1, 2 and 4 represent one embodiment of the individual anterior, middle and posterior layers of the trilaminated shingle. FIG. 3 shows the assembled trilaminate of FIGS. 1, 2 and 4. FIGS. 5–12 represent other embodiments of the trilaminate shingle with variations in the breadth and/or length of middle layer tabs or in the width of the posterior layer positioned below the anterior and middle layers. FIG. 12 also shows a modification in the color arrangement of the posterior layer with respect to the color of the anterior and middle layers.

DETAILED DESCRIPTION OF THE DRAWINGS

Figure 1:
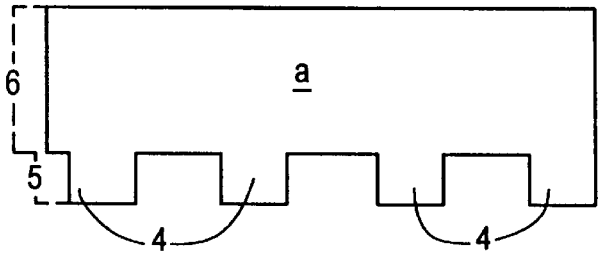
FIGS. 1 through 12 are top plan views of various trilaminate shingle embodiments within the scope of this invention.
Figure 2:
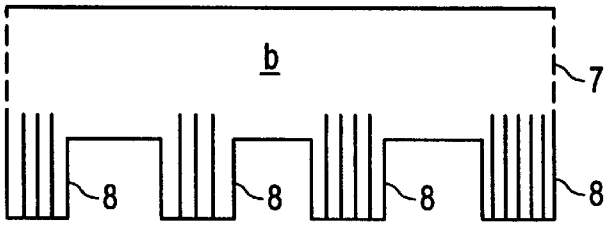
Figure 3:
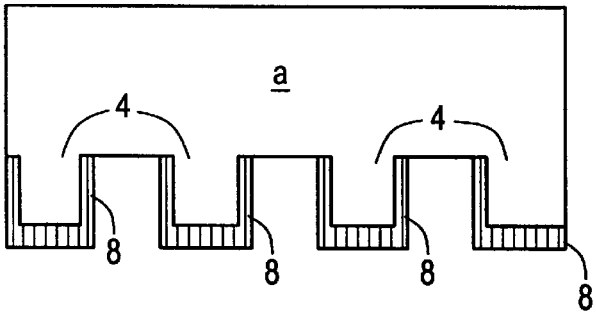
Figure 4:
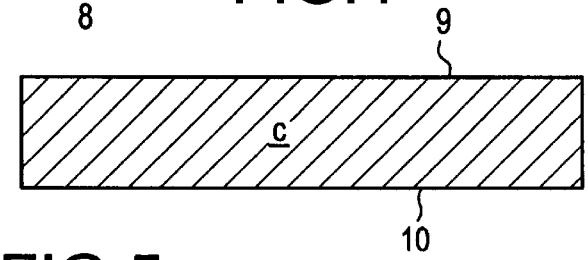
Figure 5:
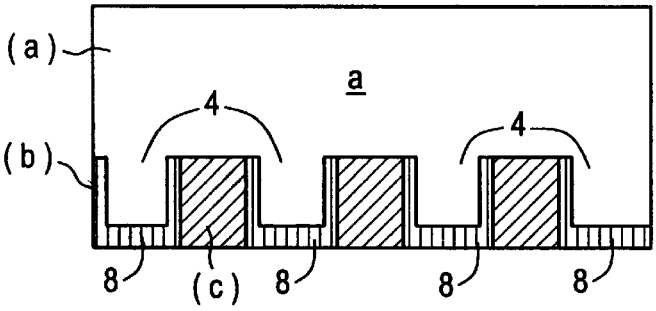

FIG. 1 illustrates detached layer anterior (a); FIG. 2 shows detached middle layer (b); FIG. 3 shows layer (a) laminated to layer (b); FIG. 4 shows detached posterior layer (c) and FIG. 5 illustrates the assembled shingle unit containing layers (a), (b) and (c) of FIGS. 1, 2 and 4.

In FIG. 1, anterior sheet layer (a) has tabs 4 of a given width and height in butt portion 5 and an undivided headlap portion 6. Middle sheet layer (b) in FIG. 2, of the same length as sheet (a), has tabs 8 in its butt portion which are correspondingly positioned to tabs 4 but which are of a height and breadth greater than tabs 4 such that, when sheet (b) is mounted beneath sheet (a), tabs 8 extend from the sides and bottom edges of tabs 4 but do not fill the spaces between tabs 4. The headlap portion of middle sheet (b) extending above tabs 8 provides an area of attachment to the undersurface of sheet (a) and can vary in height by 0.5 inch above tabs 8 to the top marginal edge of sheet (a), as shown by broken line 7 of FIG. 2.

Posterior sheet layer (c) in FIG. 4 is an undivided strip of the same length as sheet (a) and has a vertical dimension greater than the height of tabs 8 to provide an area of attachment to the undersurface of the headlap portion of sheet (b) and/or sheet (a). The bottom edge 10 opposite top edge 9 of strip (c) is mounted coextensively with the bottom edge of tabs 8 and completely fills the spaces between tabs 8, as shown in the assembled composite shingle of FIG. 5.

Figure 10:
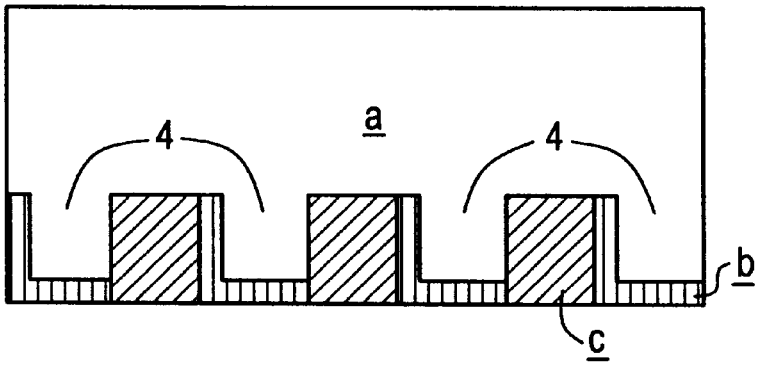
Figure 11:
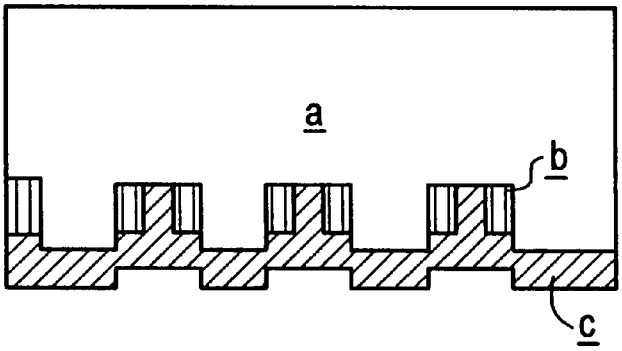
Figure 12:
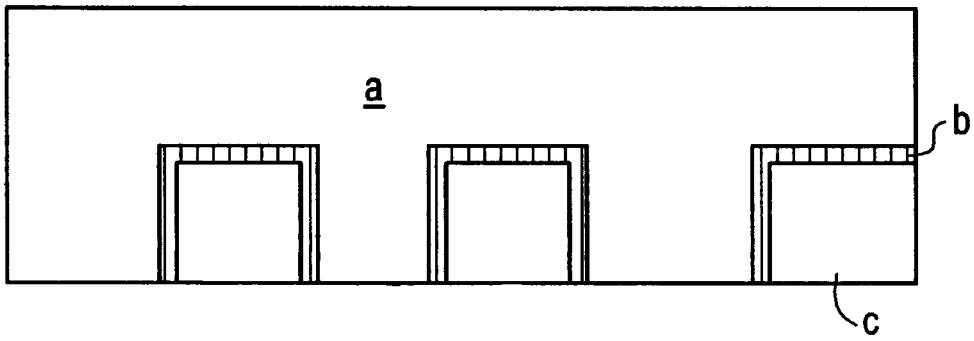

In FIGS. 1–11 of the drawings, layers (a), (b) and (c) are preferably each of a distinguishable color or shade of color, as indicated by different marking. Alternatively however, it is within the scope of the invention to have only sheet (b) of a distinguishing color or shade of color between sheets (a) and (c) of the same hue as shown in FIG. 12 or to have any two or all sheets of the same hue. Further, any two of sheets (a), (b) and (c) can be of contrasting colors or shades of color.

Figure 6:
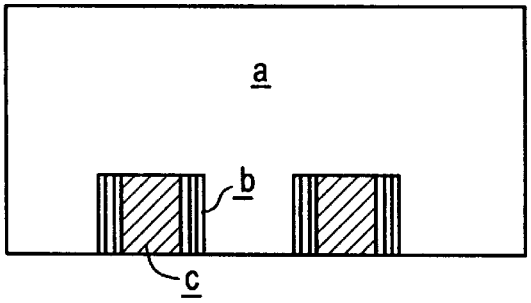

The assembled shingle of FIG. 6 shows sheets (a), (b) and (c) and differs from the shingle of FIG. 5 in that the bottom margins of tabs corresponding to tabs 8 of middle sheet (b) are coextensive with those of tabs corresponding to tabs 4 of anterior layer (a).

Figure 7:
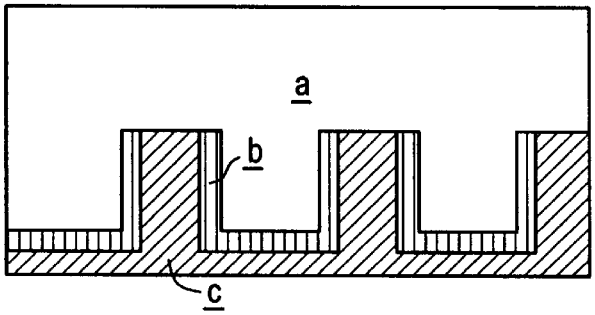

The assembled shingle of FIG. 7 shows sheets (a), (b) and (c) and differs from the shingle of FIG. 5 in that strip (c) is extended below the marginal edges of the tabs corresponding to tabs 8.

Figure 8:
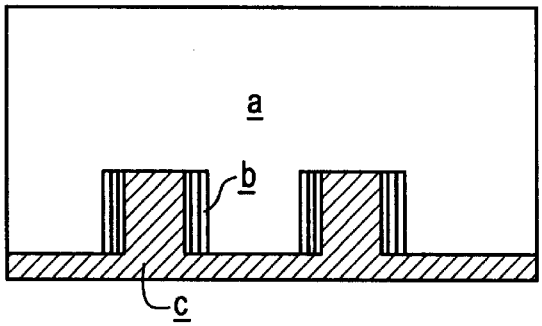
Figure 9:
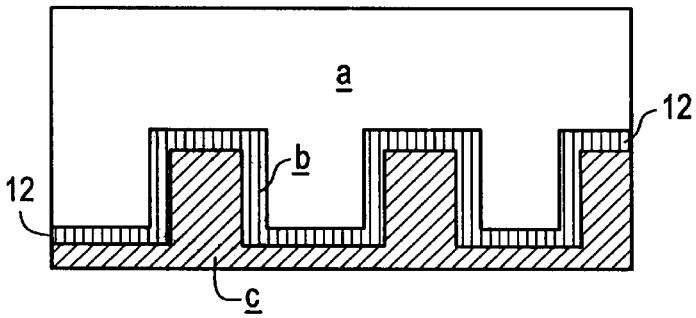

In the assembled shingle of FIG. 8, the bottom marginal edges of the tabs of sheet (b) are coextensive with the bottom tab edges of sheet (a) and the bottom margin of strip is extended below the tabs of sheet (b). In the assembled shingle of FIG. 9, the side, top and bottom edges of tabs 12 of sheet (b) form a uniform margin surrounding each tab of sheet (a) and the spaces between the tabs of (a) and the bottom marginal edge of strip (c) extends below the bottom marginal edges of tabs in strip (b).

In the assembled shingle of FIG. 10, the tabs of sheet (b), having greater height and breadth than the tabs of (a), are offset below and to one side of tabs 4 and the bottom marginal edge of strip (c) is coextensive with the bottom edges of the tales of sheet (b).

In assembled FIG. 11, the tabs of sheet (b) are shorter and wider than the tabs of sheet (a) and strip (c), extending below the tabs of sheet (a), carries indentations along its bottom marginal boundary which span the spaces between the tabs of sheet (a).

In the assembled shingle of FIG. 12, the tabs of sheet (b) are shorter and wider than the tabs of (a). The bottom edge of tabs (a), tabs (b) and strip (c) are coextensive and the color of tabs (b) are contrasted with the color of tabs (a) and strip (b): (a) and (c) being of the same color.

It will become apparent that many modifications and substitutions can be made in the above drawings without departing from the scope of this invention. For example tabs of sheet (a) and/or (b) can be of irregular configuration and/or they may be of unequal width and height, if desired. Further the spacing between the tabs of (b) can be unequal. The tabs of sheet (b) in any one of the figures can have a length equal, shorter or longer than the tabs of sheet (a). These and many more alterations can be made and will become apparent from the foregoing disclosure.

The different shadings of the individual layers in the drawings are not intended to signify a particular color value or intensity but only to indicate color contrasts between the layers and each individual layer may be lighter or darker than the shadings indicate, providing that a color contrast between the layers is optionally employed. For the purposes of this invention, it is to be understood that the trilaminated shingles include those wherein all three layers are of the same color or blends of color or wherein only two distinct colors, color blends or shades of color are employed, for example, as when layers (a) and (c); (a) and (b) or (b) and (c) are similar.

What is claimed is:

1. A trilaminated shingle comprising:

(a) an anterior layer consisting essentially of a rectangular, granular surfaced shingle sheet having an undivided headlap portion and a butt portion comprising a plurality of tabs of a given average breadth separated by spaces approximately 0.50 to 1.25 the breadth of one of said tab;

(b) a middle layer consisting essentially of a longitudinally coextensive rectangular, granular surfaced shingle sheet of an overall width up to equal the width of the anterior layer, having the same number of tabs as those of (a), said tabs of (b) larger in breadth and/or height with respect to the tabs of (a) but narrower than the spaces between the tabs of (a), said middle layer being attached to the undersurface of said anterior layer in a manner such that the tabs of (b) are positioned under the tabs of (a) and extend from a side and/or bottom edge of tab (a) when assembled and partially fill the side spaces between the tabs of (a) and (c) a posterior layer of an undivided, longitudinally coextensive rectangular strip exposable through and completely filling lateral spaces between said mated tabs of (a) and (b) and having granules on its surface in at least its exposed areas, said strip having a width greater than the height of the tabs of (b) and being mounted on the undersurface of (b) or (a) and (b).

2. The shingle of claim 1 wherein the tabs of (b) are of complementary configuration with respect to the tabs of (a).

3. The shingle of claim 1 wherein the tabs of (b) are of greater breadth than those of (a).

4. The shingle of claim 3 wherein the tabs of layer (b) extend below the tabs of layer (a).

5. The shingle of claim 4 wherein the tabs of layer (b) form a uniform border around each of the tabs of layer (a) and the top of the spaces between tabs.

6. The shingle of claim 1 wherein the tabs of (b) are centered under the tabs of (a).

7. The shingle of one of claims 1 and 6 wherein the strip of layer (c) extends below the tabs of layer (b).

8. The shingle of one of claims 1 and 6 wherein the bottom marginal edge of said strip is coextensive with the bottom edge of tabs of layer (b).

9. The shingle of claim 1 wherein the tabs of (b) are offset to one side of the tabs of (a).

10. The shingle of claim 1 wherein at least two of the tabs of layer (a) are of unequal height.

11. The shingle of claim 1 wherein at least two of the tabs of layer (a) are of unequal breadth.

12. The shingle of claim 1 wherein at least one of the tabs of layer (a) has a broken line boundary.

13. The shingle of claim 1 wherein the tabs of layer (b) are shorter than the tabs of layer (a).

14. The shingle of claim 13 wherein strip (c) extends below the tabs of layer (a) and the contour of the bottom marginal edge of strip (c) follows the contour of the bottom edges of the tabs of layer (a) and has indentations spanning the spaces between the tabs of layer (a).

15. The shingle of claim 1 wherein the tabs of layer (b) are of a color or shade of color which is distinguishable from that of the tabs of (a) and/or strip (c).

16. The shingle of claim 15 wherein the tabs of layer (a) and strip (c) are of distinguishable colors or shades of color.

17. The shingle of claim 1 wherein exposable areas of layers (a), (b) and (c) are each of a distinguishable color or shades of color.

18. The shingle of claim 1 wherein the spacing between the tabs of (a) and/or (b) are unequal.

* * * * *